US005092908A

United States Patent [19]

Feldman et al.

[11] Patent Number: 5,092,908

[45] Date of Patent: Mar. 3, 1992

[54] COMPOSITION FOR IMPROVING COLD FLOW PROPERTIES OF MIDDLE DISTILLATES (OP-3571)

[75] Inventors: Nicholas Feldman, Woodbridge; Jacob J. Habeeb, Westfield, both of N.J.

[73] Assignee: Exxon Research and Engineering Company, Florham Park, N.J.

[21] Appl. No.: 545,028

[22] Filed: Jun. 28, 1990

[51] Int. Cl.[5] ..... C10L 1/26; C10L 1/22; C10L 1/18; C10L 1/24

[52] U.S. Cl. ..... 44/380; 44/388; 44/408; 44/418

[58] Field of Search ..... 44/335, 393, 394, 370, 44/374, 388, 408, 418

[56] References Cited

U.S. PATENT DOCUMENTS

| | | | |
|---|---|---|---|
| 2,786,812 | 3/1957 | McDermott | 252/32.7 E |
| 2,882,228 | 4/1959 | Watson et al. | 252/32.7 E |
| 2,894,951 | 7/1959 | Millikan | 252/32.7 E |
| 3,048,479 | 8/1962 | Ilnyckyj et al. | 44/393 |
| 3,129,699 | 4/1964 | Millikan | 44/335 |
| 4,211,534 | 7/1980 | Feldman | 44/394 |
| 4,537,602 | 8/1985 | Rossi et al. | 44/394 |

*Primary Examiner*—Margaret B. Medley
*Attorney, Agent, or Firm*—Roy J. Ott

[57] ABSTRACT

A wax-containing middle distillate, such as diesel fuel, having improved low temperature flow properties comprises three or more components including (A) an oil-soluble ethylene backbone flow improving polymer such as ethylene vinyl acetate copolymer, (B) a hydrocarbyl substituted amine salt and/or amide of a carboxylic acid or anhydride such as phthalic anhydride salts, and (C) a hydrocarbyl substituted amine salt of a derivative of phosphoric acid such as the dihydrogenated tallow amine salt of dialkyldithiophosphoric acid.

16 Claims, No Drawings

COMPOSITION FOR IMPROVING COLD FLOW PROPERTIES OF MIDDLE DISTILLATES (OP-3571)

BACKGROUND OF THE INVENTION

1. Field of the Invention

This invention relates to an additive composition for improving the cold flow properties of middle distillates such as diesel fuels and heating oils. More particularly, the invention relates to a diesel fuel composition having improved cold flow properties imparted by an additive composition comprising three or more components including (A) an oil-soluble ethylene backbone flow improving polymer, (B) a hydrocarbyl substituted amine salt and/or amide of a carboxylic acid or anhydride and (C) a hydrocarbyl substituted amine salt of a derivative of a phosphoric acid.

2. Description of the Prior Art

Serious problems have been encountered by heating oils and diesel and jet fuels that are subject to low temperatures. These petroleum products are frequently subjected to low temperatures below their pour point, resulting either in distribution or operating difficulties or both. For example, the distribution of heating oils by pumping or siphoning is rendered difficult or impossible at temperatures around or below the pour point of the oil. Similarly, the flow of fuels at such low temperatures cannot be maintained through filters, leading to the failure of equipment to operate.

It is, of course, well known to add pour depressants to middle distillates, such as heating oils and diesel fuels, to improve their cold flow properties. For example, various polymers, useful as middle distillate pour point depressants, prepared from ethylene have been described in the patent literature. These pour depressants include copolymers of ethylene and vinyl esters of lower fatty acids such as vinyl acetate (U.S. Pat. No. 3,048,479); copolymers of ethylene and alkyl acrylate (Canadian Patent No. 676,875); terpolymers of ethylene with vinyl esters and alkyl fumarates (U.S. Pat. Nos. 3,304,261 and 3,341,309); polymers of ethylene (British Patents Nos. 848,777 and 993,744); chlorinated polyethylene (Belgian Patent No. 707,371 and U.S. Pat. No. 3,337,313): etc.

Polymers having alkyl groups in the range of $C_6$ to $C_{18}$, such as homopolymers and copolymers of olefins, alkyl esters of unsaturated dicarboxylic acids (e.g., copolymers of dialkyl fumarate with vinyl acetate), and copolymers of olefins and said esters, are known in the art, principally as lube oil pour depressants and/or V.I. improvers. For example, U.S. Pat. No. 2,379,728 teaches olefin polymers as lube pour depressants; U.S. Pat. No. 2,460,035 shows polyfumarates; U.S. Pat. No. 2,936,300 shows a copolymer of dialkyl fumarate and vinyl acetate; while U.S. Pat. No. 2,542,542 teaches copolymers of olefins, such as octadecene with maleic anhydride esterified with alcohol, e.g., lauryl alcohol, in lube and heating oils.

Combinations of various pour depressants and flow improvers for middle distillates are also well known. For example, U.S. Pat. No. 4,153,422 describes a pour point depressing combination of ethylene vinyl ester copolymers with a polyester of a $C_{14}$ to $C_{16}$ substantially straight chained alkyl ester of an ethylenically unsaturated mono carboxylic acid.

U.K. Patent No. 1,469,016 teaches ethylene polymers or copolymers which are pour depressants for distillate fuels, in combination with a second polymer having alkyl groups of 6 to 18 carbon atoms, which is a polymer of an olefin or unsaturated dicarboxylic acid ester, useful in improving the cold flow properties of distillate fuel oils.

U.S. Pat. No. 3,982,909 teaches nitrogen compounds such as amides, diamides, ammonium salts or monoesters of dicarboxylic acids, alone or in combination with a hydrocarbon microcrystalline wax and/or a pour point depressant, particularly an ethylene backbone polymeric pour point depressant, are wax crystal modifiers and cold flow improvers for middle distillate fuel oils, particularly diesel fuel.

U.S. Pat. Nos. 3,444,082 and 3,846,093 teach various amides and salts of alkenyl succinic anhydride reacted with amines, in combination with ethylene copolymer pour point depressants, for distillate fuels.

U.S. Pat. Nos. 2,894,951 and 3,129,699 describe the use of heterocyclic polyamine salts of partial esters of phosphorodithioic acids of the formula $(RO)_2P(s)SH$ as additives to improve the ignition characteristics of diesel fuel.

Middle distillate fuel oils containing three or more additives for improvement of cold flow properties are also known. For example, U.S. Pat. No. 4,211,534 discloses a three component additive combination for distillate fuel oils comprising (A) an ethylene backbone distillate fuel oil pour depressant polymer, (B) a second polymer having alkyl side chains of 6 to 30 carbon atoms and derived from carboxylic acid ester or olefins, and (C) a nitrogen compound, e.g., amides and salts of a carboxylic acid or anhydride.

SUMMARY OF THE INVENTION

The present invention is based on the finding that the presence of the claimed three component system imparts improved flow properties to middle distillates as compared to the improvement imparted by equal or greater amounts of one or two of the components.

A wax-containing middle distillate having improved low temperature flow properties comprises three or more components including:

(A) 0.001 to 0.5 weight percent, preferably 0.005–0.10 weight percent, of an oil-soluble ethylene backbone flow improving polymer having a number average molecular weight in the range of about 500 to 50,000;

(B) 0.002 to 0.5 weight percent, preferably 0.01–0.15 weight percent, of an oil-soluble hydrocarbyl substituted amine salt and/or amide of a carboxylic acid or anhydride having 1 to 4 carbonyl groups;

(C) 0.001 to 0.5 weight percent, preferably 0.005–0.10 weight percent, of an oil-soluble hydrocarbyl substituted amine salt of a compound having the formula:

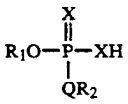

wherein X is oxygen or sulfur, preferably sulfur, and $R_1$ and $R_2$ are selected from hydrogen and a hydrocarbyl group containing 1 to 28 carbon atoms, preferably an alkyl group containing 4 to 12 carbon atoms, and at least one of the radicals $R_1$ or $R_2$ is a hydrocarbyl, preferably an alkyl group, group containing 3–18 carbon atoms; wherein the aforesaid weight percents are based on the weight of the total fuel composition.

DETAILED DESCRIPTION OF THE INVENTION

The First Component: the Ethylene Backbone Flow Improving Polymer.

The ethylene backbone polymers are of the type known in the art as wax crystal modifiers, e.g. pour depressants and cold flow improvers for distillate fuel oils. These polymers will have a polymethylene backbone which is divided into segments by hydrocarbon or oxy-hydrocarbon side chains, or by alicyclic or heterocyclic structures or by chlorine atoms. They may be simply homopolymers of ethylene as prepared by free radical polymerization so as to result in some branching. More usually, they will comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight in the range of about 500 to 50,000, preferably about 800 to about 20,000, e.g., 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

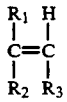

wherein $R_1$ is hydrogen or methyl; $R_2$ is a —$OOCR_4$ or —$COOR_4$ group wherein $R_4$ is hydrogen or a $C_1$ to $C_{28}$, more usually $C_1$ to $C_{16}$, and preferably a $C_1$ to $C_8$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, methyl methacrylate, etc. Examples of monomers where $R_1$ is hydrogen and either or both of $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate, ethyl methyl fumarate, etc. It is preferred, however, that the acid groups be completely esterified as free acid groups tend to promote haze if moisture is present in the oil.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Vinyl acetate is particularly preferred as the monomer to be copolymerized with ethylene.

A further description of the ethylene backbone polymer and methods for making such polymers are given in U.S. Pat. No. 4,211,534 which is incorporated herein by reference.

The Second Component: the Hydrocarbyl Substituted Amine Salt and/or Amide of a Carboxylic Acid or Anhydride.

The second component includes oil-soluble amine salts and/or amides, which are known in the art and are generally formed by reaction of at least one molar proportion hydrocarbyl substituted amines with a molar proportion of hydrocarbyl acid having 1 to 4 carboxylic acid groups, or their anhydrides.

In the case of polycarboxylic acids, or anhydrides thereof, all acid groups may be converted to amine salts or amides, or part of the acid groups may be converted to esters by reaction with hydrocarbyl alcohols, or part of the acid groups may be left unreacted.

The hydrocarbyl groups of the preceding amine, carboxylic acid or anhydride, and alcohol compounds include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g. $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil soluble. The number of carbon atoms necessary to confer oil solubility will vary with the degree of polarity of the compound. The compound will preferably also have at least one straight chain alkyl segment extending from the compound containing 8 to 40 e.g. 12 to 30 carbon atoms. This straight chain alkyl segment may be in one or several of the amine or ammonium ion, or in the acid, or in the alcohol (if an ester group is also present). At least one ammonium salt, or amine salt, or amide linkage is required to be present in the molecule.

The amines may be primary, secondary, tertiary or quaternary, but preferably are secondary. If amides are to be made, then primary or secondary amines will be used.

Examples of primary amines include n-dodecyl amine, n-tridecyl amine, $C_{13}$ Oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methyl-behenyl amine, ditallow amine etc. Examples of tertiary amines include coco-diethyl amine, cyclohexyl-diethyl amine, coco-dimethyl amine, tri-n-octyl amine, di-methyl-dodecyl amine, methyl-ethyl-coco amine, methyl-cetyl stearyl amine, etc.

Amine mixtures may also be used and many amines derived from natural materials are mixtures. Thus, coco amines derived from coconut oil is a mixture of primary amines with straight chain alkyl groups ranging from $C_8$ to $C_{18}$. Another example is tallow amine, derived from hydrogenated tallow acids, which amine is a mixture of $C_{14}$ to $C_{18}$ straight chain alkyl groups. Tallow amine is particularly preferred.

Examples of the carboxylic acids or anhydrides, include formic, acetic, hexanoic, lauric, myristic, palmitic, hydroxy strearic, behenic, naphthenic, salicyclic, acrylic, linoleic, dilinoleic, trilinoleic, maleic, maleic anhydride, fumaric, succinic, cuccinic anhydride, alkenyl succinic anhydride, adipic, glutaric, sebacic, lactic, malic, malonic, citraconic, phthalic acids (o, m, or p), e.g. terephthalic, phthalic anhydride, citric, gluconic, etc.

Phthalic anhydride amides or amine salts are particularly preferred as the second component of the additive composition of the invention.

The amides can be formed in a conventional manner by heating a primary or secondary amine with acid, or acid anhydride. The ammonium salts are also conventionally prepared by simply mixing the amine (or ammonium hydroxide) with the acid or acid anhydride, or the partial ester of a polycarboxylic acid, or partial amide of a polycarboxylic acid, with stirring, generally with mild heating (e.g. 70°-80° C.).

The Third Component: the Hydrocarbyl Substituted Amine Salt of a Phosphoric Acid Derivative.

The phosphoric acid derivative will have the formula:

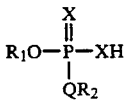

wherein X is oxygen or sulfur, preferably sulfur, and $R_1$ and $R_2$ are selected from hydrogen and a hydrocarbyl group containing 1 to 28 carbon atoms, preferably an alkyl group containing 4 to 12 carbon atoms, and at least one of the radicals $R_1$ or $R_2$ is a hydrocarbyl, preferably an alkyl group, group containing 3-18 carbon atoms.

Specific examples of the phosphoric acid derivative include dioctyldithiophosphoric acid; dihexyldithiophosphoric acid; dibutyldithiophosphoric acid; didodecylphenyldithiophosphoric acid; dioctylphosphoric acid; butylhexyldithiophosphoric acid; butyloctyldithiophosphoric acid; and the like.

The third component is formed in a conventional manner by mixing substantially equimolar amounts of the phosphoric acid derivative and a hydrocarbyl substituted amine at temperatures generally in the range of 15°-100° C. The hydrocarbyl substituted amines include those described with respect to the preparation of the aforedescribed second component. The preferred amines include the long straight chain alkyl amines containing 8-40, preferably 12 to 18, carbon atoms. Naturally occurring amines, which are generally mixtures, are preferred. Examples include coco amines derived from coconut oil which is a mixture of primary amines with straight chain alkyl groups ranging from $C_8$ to $C_{18}$. Another example is tallow amine, derived from hydrogenated tallow acids, which amine is a mixture of $C_{14}$ to $C_{18}$ straight chain alkyl groups. Tallow amine is particularly preferred.

The Middle Distillate Oil.

The middle distillates will generally boil within the range of about 120° C. to about 500° C., e.g. 150° C. to about 400° C. The fuel oil can comprise atmospheric distillate or vacuum distillate, or cracked gas oil or a blend in any proportion of straight run and thermally and/or catalytically cracked distillates, etc. The most common petroleum distillate fuels are kerosene, jet fuels, diesel fuels and heating oils. The heating oil may be a straight atmospheric distillate, or it may frequently contain minor amounts, e.g. 0 to 35 wt. %, of vacuum gas oil and/or of cracked gas oils. The low temperature flow problem is most usually encountered with diesel fuels and with heating oils.

Oil soluble, as used herein, means that the additives are soluble in the fuel at ambient temperatures, e.g., at least to the extent of about 0.1 wt. % additive in the fuel oil at 25° C., although at least some of the additive comes out of solution near the cloud point in order to modify the wax crystals that form.

The additive combination of this invention may be dissolved in a suitable solvent for ease in handling, as is conventional practice. The additive concentrate may comprise from about 30 to 80 wt. % of a suitable solvent, such as a hydrocarbon diluent, and about 70 to 20 wt. % of an additive combination comprising:

(A) one part by weight of an oil-soluble ethylene backbone distillate flow improving polymer having a number average molecular weight in the range of about 500 to 50,000;

(B) 0.10 to 10 parts by weight of an oil-soluble hydrocarbyl substituted amine salt or amide of a carboxylic acid or anhydride; and (C) 0.10 to 10 parts by weight of an oil-soluble hydrocarbyl substituted amine salt of a phosphoric acid derivative having the formula:

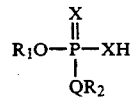

wherein X is oxygen or sulfur and $R_1$ and $R_2$ are selected from hydrogen and a hydrocarbyl group containing 1 to 28 carbon atoms and at least one of the radicals $R_1$ or $R_2$ is a hydrocarbyl group containing 3 to 18 carbon atoms.

The invention will be further understood by reference to the following Examples which include preferred embodiments of the invention.

EXAMPLE 1

In this Example, the flow improvement imparted by the three component additive composition of the invention is compared to the flow improvement imparted by equal or greater amounts of an additive composition containing only the first two components of the additive composition of the invention.

The oil-soluble ethylene backbone polymer used in this Example is an ethylene-vinyl acetate copolymer containing about 38 wt. % vinyl acetate and having a number average molecular weight of about 1800 (VPO). The copolymer was prepared in accordance with the teachings of U.S. Pat. No. 3,916,916 which is incorporated herein by reference. This copolymer is hereinafter referred to as Additive A.

The second component used in this Example was a dihydrogenated tallow amine salt of the monoamide of phthalic anhydride hereinafter referred to as Additive B. This material was conventionally prepared by reacting stoichiometric amounts of phthalic anhydride with the amine.

The third component used in this Example was a dihydrogenated tallow amine salt of dioctyldithiophosphoric acid hereinafter referred to as Additive C. This material was prepared as follows.

A tallow amine solution was prepared by dissolving 51 grams of dihydrogenated tallow amine sold under the tradename Armeen 2HT in 600 ml. of toluene. A solution of 35 grams of di n-octyl dithiophosphoric acid in 200 ml. of toluene was then slowly added with constant stirring at room temperature to the tallow amine solution. Upon completion of the addition, the mixture was stirred for about 60 minutes and the toluene was then boiled off under low heat (about 50° C.) under a nitrogen stream to isolate the product.

The middle distillate tested in this Example is a diesel fuel having a +12° F. ASTM cloud point, a 0° F. ASTM pour point, and Various amounts of Additives A, B and C were blended in the diesel fuel and tested for flow improvement in the ASTM D-4539 Low Temperature Flow Test (LTFT). In this test, the fuel is cooled at 1° C. per hour to the test temperature to determine the lowest temperature at which the fuel will flow through a suction tube having a filter screen. The results obtained are shown in the following Table I.

TABLE I

| Weight % Additive (100% Active Ingredient) in Diesel Fuel | | | LTFT Results at °F. | | | |
|---|---|---|---|---|---|---|
| Additive A | Additive B | Additive C | +7 | +5 | 0 | −5 |
| 0.20 | — | — | Fail | Fail | | |
| — | 0.20 | — | Fail | Fail | | |
| 0.08 | 0.12 | — | Fail | Fail | | |
| — | — | 0.10 | Pass | Fail | | |
| 0.03 | 0.045 | 0.03 | | Pass | Pass | Pass |
| 0.03 | 0.045 | 0.02 | | Pass | Pass | Pass |

It can be seen from the data in Table I that lower flow temperatures are obtained at lower total additive concentrations when all three additives are used as compared to higher concentrations of Additives A and/or B.

EXAMPLE II

Additives A, B and C were tested in another diesel fuel. The fuel had a −5° C. ASTM cloud point, a −12° C. ASTM pour point, a The LTFT results from this test are shown in Table II. It is seen that the presence of all three components imparts a greater flow improvement than an equal concentration of Additives A and B.

TABLE II

| Weight % Additive (100% Active Ingredient) in Diesel Fuel | | | Lowest Pass Temperature °C. in LTFT |
|---|---|---|---|
| Additive A | Additive B | Additive C | |
| 0.015 | 0.045 | | −13 |
| 0.012 | 0.048 | — | −12 |
| 0.030 | 0.030 | — | −13 |
| 0.012 | 0.030 | 0.018 | −20 |

What is claimed is:

1. A wax-containing middle distillate fuel composition comprising:

(A) about 0.001 to 0.5 wt. % of an oil-soluble ethylene backbone distillate flow improving polymer having a number average molecular weight in the range of about 500 to 50,000;

(B) about 0.001 to 0.5 wt. % of an oil-soluble hydrocarbyl substituted amine salt or amide of a carboxylic acid or anhydride; and (C) about 0.001 to 0.5 wt. % of an oil-soluble hydrocarbyl substituted amine salt of a phosphoric acid derivative having the formula:

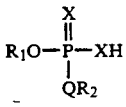

wherein X is oxygen or sulfur and $R_1$ and $R_2$ are selected from hydrogen and a hydrocarbyl group containing 1 to 28 carbon atoms and at least one f the radicals $R_1$ or $R_2$ is a hydrocarbyl group containing 3 to 18 carbon atoms;

wherein the aforesaid weight percents are based on the weight of the total fuel composition.

2. The middle distillate fuel of claim 1 wherein the hydrocarbyl substituted amine used in the preparation of additives B and C comprises at least one straight chain alkyl group containing 8 to 40 carbon atoms.

3. The middle distillate fuel of claim 2 wherein said fuel is a diesel fuel.

4. The middle distillate fuel of claim 3 wherein at least one of the radicals $R_1$ or $R_2$ is a hydrocarbyl radical containing 3–18 carbon atoms.

5. The middle distillate fuel of claim 4 wherein the oil-soluble ethylene backbone distillate flow improving polymer is a copolymer of ethylene and vinyl acetate.

6. The middle distillate fuel of claim 5 wherein X in the formula for the phosphoric acid derivative represents sulfur.

7. The middle distillate fuel of claim 6 wherein derivative (B) is an amine salt or amide of phthalic anhydride.

8. The middle distillate fuel of claim 7 wherein the hydrocarbyl substituted amine used in the preparation of additive (C) is tallow amine.

9. The middle distillate fuel of claim 1 wherein said fuel is a diesel fuel, said additive (A) is an ethylene vinyl acetate copolymer, and said additive (B) is a phthalic anhydride amide or amine salt.

10. The middle distillate fuel of claim 9 wherein additive (C) is a dihydrogenated tallow amine salt.

11. The middle distillate fuel of claim 1 wherein additive (A) is an ethylene vinyl acetate copolymer, additive (B) is a tallow amine salt of phthalic anhydride and additive (C) is a tallow amine salt of a alkyl substituted dithiophosphoric acid.

12. A wax-containing diesel fuel comprising:

(A) 0.005–0.10 wt. % of an oil-soluble copolymer of ethylene and vinyl acetate;

(B) 0.01–0.15 wt. % of an oil-soluble amine salt or amide of phthalic anhydride; and (C) 0.005–0.10 wt. % of an oil-soluble $C_{12}$–$C_{30}$ alkyl amine salt of a compound having the formula:

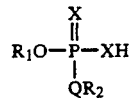

wherein X is oxygen or sulfur and $R_1$ and $R_2$ are selected from hydrogen and an alkyl group containing 4 to 12 carbon atoms, and at least one of the radicals $R_1$ or $R_2$ is an alkyl group containing 4 to 12 carbon atoms; wherein the aforesaid weight percents are based on the weight of the total fuel composition.

13. The diesel fuel of claim 12 wherein X represents sulfur and $R_1$ and $R_2$ are $C_4$–$C_{12}$ alkyl groups.

14. The diesel fuel of claim 13 wherein additives (B) and (C) are tallow amine salts.

15. An additive combination comprising:

(A) one part by weight of an oil-soluble ethylene backbone distillate flow improving polymer having a number average molecular weight in the range of about 500 to 50,000;

(B) 0.1 to 10 parts by weight of an oil-soluble hydrocarbyl substituted amine salt or amide of a carboxylic acid or anhydride; and (C) 0.1 to 10 parts by weight of an oil-soluble hydrocarbyl substituted amine salt of a phosphoric acid derivative having the formula:

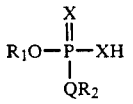

wherein X is oxygen or sulfur and $R_1$ and $R_2$ are selected from hydrogen and a hydrocarbyl group containing 1 to 28 carbon atoms and at least one of the radicals $R_1$ or $R_2$ is a hydrocarbyl group containing 3 to 18 carbon atoms.

16. An additive concentrate comprising from about 30 to 80% of a hydrocarbon diluent and from about 70 to 20 wt. % of the additive combination of claim 15.

* * * * *